United States Patent [19]

Vishnevetsky

[11] Patent Number: 4,978,034

[45] Date of Patent: Dec. 18, 1990

[54] DEVICE FOR SUPPORTING A TOOTHPASTE CONTAINER

[76] Inventor: Philip Vishnevetsky, 31-18 Brighton 4 St., Brooklyn, N.Y. 11235

[21] Appl. No.: 385,423

[22] Filed: Jul. 27, 1989

[51] Int. Cl.[5] ..... B65D 35/28

[52] U.S. Cl. ..... 222/102; 248/108

[58] Field of Search ..... 248/108, 109; 222/100, 222/102, 103, 105, 182

[56] References Cited

U.S. PATENT DOCUMENTS

| | | | |
|---|---|---|---|
| 1,590,626 | 6/1926 | Highley | 222/100 X |
| 2,550,537 | 4/1951 | Derrick | 222/102 |
| 3,194,452 | 7/1965 | Sanderford | 222/102 X |
| 3,197,072 | 7/1965 | Dick | 222/102 |
| 3,204,824 | 9/1965 | McGraw, Jr. | 222/100 |
| 3,257,039 | 6/1966 | Trutza | 222/102 |
| 3,606,090 | 9/1971 | Byers | 222/102 |
| 4,213,542 | 7/1980 | Wilson | 222/105 X |
| 4,226,336 | 10/1980 | Young | 222/102 |
| 4,607,763 | 8/1986 | Wright | 248/108 X |

FOREIGN PATENT DOCUMENTS

| | | | |
|---|---|---|---|
| 0083196 | 1/1954 | Norway | 222/102 |
| 0136133 | 6/1952 | Sweden | 222/102 |

*Primary Examiner*—Ramon O. Ramirez

*Attorney, Agent, or Firm*—Ilya Zborovsky

[57] ABSTRACT

A support for a toothpaste container not only supports the container, but also is provided with a mechanism for pulling the container through and squeezing a toothpaste from the same.

2 Claims, 2 Drawing Sheets

DEVICE FOR SUPPORTING A TOOTHPASTE CONTAINER

BACKGROUND OF THE INVENTION

The present invention relates to devices for supporting toothpaste containers.

Devices of the above mentioned general type are known in the art. The known device performs a passive function of supporting toothpaste container without actively acting on them. It is however desirable to provide a very special action to the toothpaste containers. It is well known that after a certain period of use of a toothpaste accommodated in the container, a remaining part of the toothpaste cannot be extracted from the container. This leads to a certain loss of the toothpaste for a user and discarding of the container with a paste portion which would still be useable otherwise. It is to be understood that it is desirable to provide devices to achieve as complete as possible use of the toothpaste.

SUMMARY OF THE INVENTION

Accordingly, it is an object of the present invention to provide a device for supporting a toothpaste container which avoids the disadvantages of the prior art.

More particularly it is an object of the present invention to provide a device of this type which insures actually complete withdrawal and use of a toothpaste from the toothpaste container.

In keeping with these objects and with others which will become apparent hereinafter , one feature of the present invention resides, briefly stated, in a device which has means for engaging and moving a toothpaste container so as to squeeze the same, and means for actuating the first mentioned means by a user, so as to squeeze the container by a user-applied force and to squeeze the toothpaste from the container to the very end portion thereof.

When the device is designed in accordance with the present invention, it insures a complete withdrawal of the toothpaste from the container, to be used for toothbrushing by a user.

The novel features of the invention are set forth in particular in the appended claims. The invention itself, however, both as to its construction and method of operation will be best understood from the following description of preferred embodiments which is accompanied by the following drawings.

DESCRIPTION OF PREFERRED EMBODIMENTS

Figure 1:
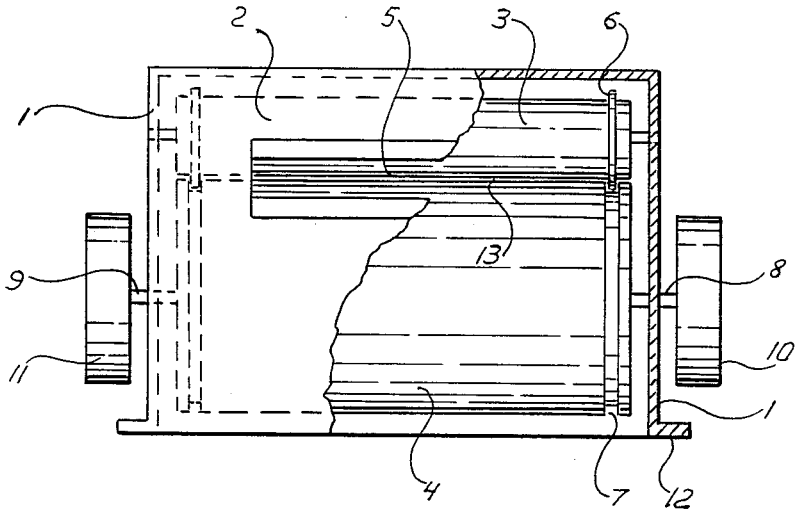
FIG. 1 is a view showing a device for supporting a toothpaste container in accordance with the present invention in a schematic fashion.

A device for supporting a toothpaste container in accordance with a first embodiment is shown in FIG. 1. It has a housing provided with two side walls 1 as well as a front wall 2 and a not shown rear wall. Two rollers

3 and 4 are rotatably supported in the housing, for example by shafts rotatably supported in the side walls 1 preferably through not shown bearings. The rollers form therebetween a gap which can be as little as possible. The front wall is provided with a slot 5 for introducing a toothpaste container. Interengaging projections and grooves 6 and 7 can be also provided in the rollers to keep them in engagement and to prevent axial displacement.

The shaft of the roller 4 has two shaft portions 8 and 9 connected with handles 10 and 11. The housing has a supporting portion 12 to support the device on any support.

The device operates in the following manner. A toothpaste container with a toothpaste is introduced into a conical inlet funnel in front of the gap 13 between the rollers through the slot 5 in the front wall 2 of the device housing. One of the handles 10 and 11 are turned by a user, depending on whether a user is right-handed or left-handed, and the toothpaste container is pulled into the gap 13. During the pulling it is squeezed by the rollers and a portion of the toothpaste emerges from an outlet opening of the container. It is believed to be clear that the container must be formed so that it is squeezable by the rollers. After certain time of use, the user further turns the handle and further squeezes the container by pulling a next portion of the container through the gap 13. All paste can be withdrawn from the container since the latter can be squeezed till its very end.

Figure 2:
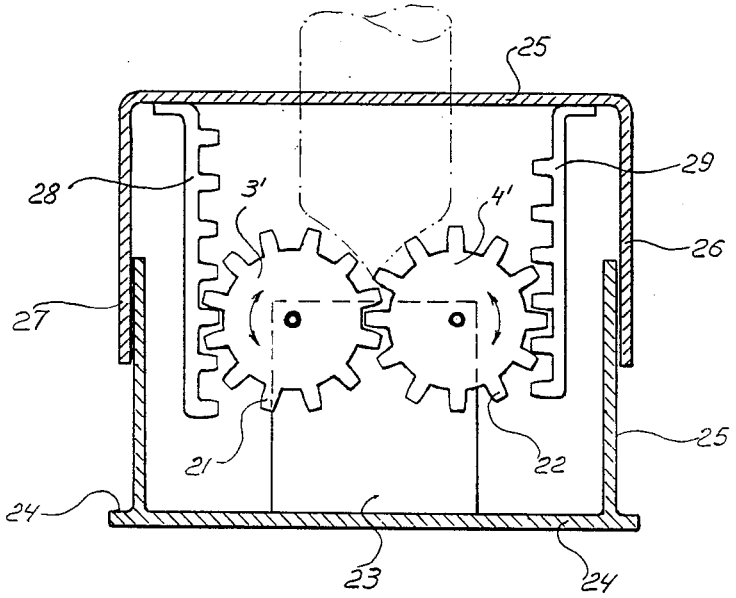
FIG. 2 is a view showing the inventive device in accordance with another embodiment of the present invention.

In the embodiment of FIG. 2 the rollers 3' and 4' are provided with toothed gearings or teeth 21 and 22 interengaging with one another. The rollers are rotatably supported on a central upstanding part 23 of the housing. The part 23 together with a bottom plate 24 and a side wall 25 are stationary. The top wall 26 and a side wall 27 are vertically movable. The parts 23,24,25 together form a stationary housing portion, while the parts 26, 27 together form a movable housing portion. Toothed racks 28 and 29 are mounted on the movable housing portion and engage the gearings of the rollers at two opposite sides.

The toothpaste container in this embodiment is also engaged and squeezed by the rollers. However, the rollers are driven in rotation by vertical downward pushing of the movable housing portion 26,27 by a user. Under the action of this pushing;, the racks 28,29 turn the gearings 21,22 of the rollers and rotate the latter.

Figure 3:
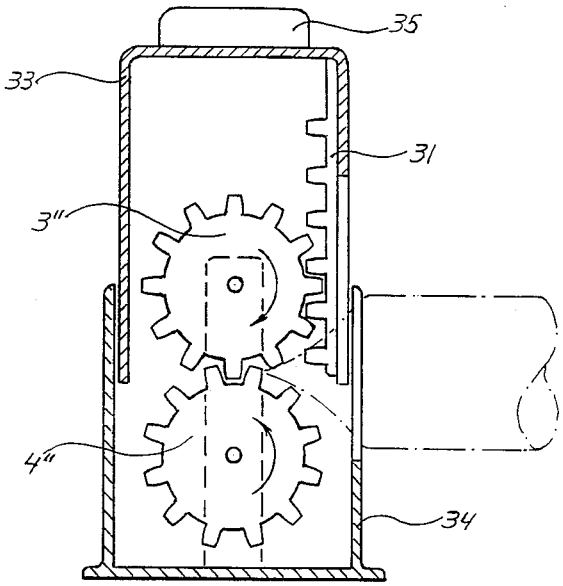
FIG. 3 is a view showing the inventive device in accordance with a further embodiment of the present invention.

While in the embodiments of FIGS. 1 and 2 the rollers are located horizontally near one another, in the embodiment of FIG. 3 the rollers 3" and 4" are spaced vertically. A toothed rack 31 engages the teeth of the roller 3" and is mounted on an upper movable housing portion 33, while a toothed rack 32 engages the teeth of the roller 4" and is mounted on a lower stationary housing part 34. BY pushing a button 35 downwardly the rollers' rotation is activated by the toothed racks, with resulting squeezing the toothpaste container by the rollers.

Figure 4:
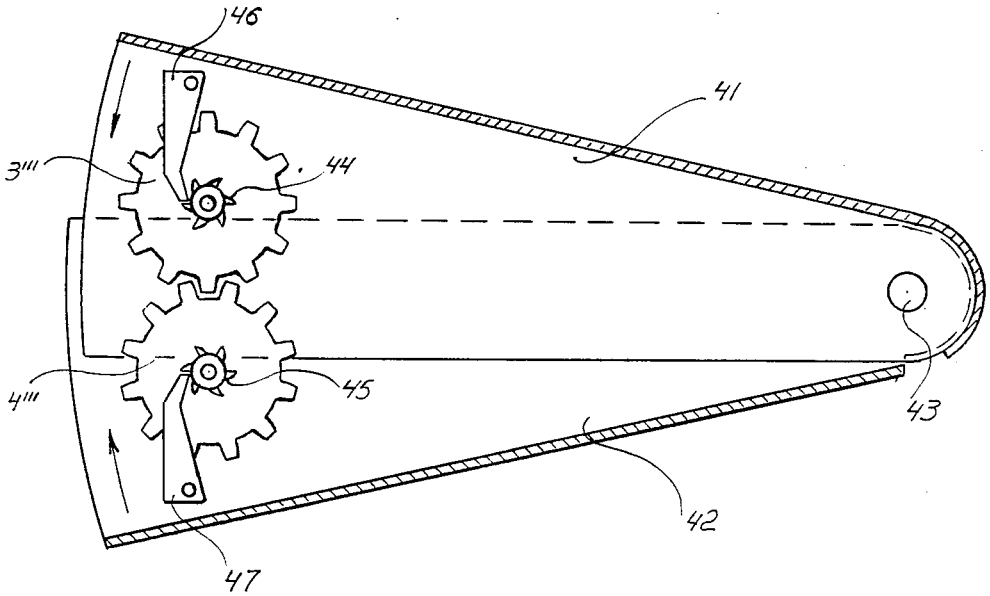
FIG. 4 is a view showing the device in accordance with still a further embodiment.

In the embodiment of FIG. 4 the rollers 3''' and 4''' are turnably mounted on two arms 41 and 42 which are turnably connected with one another by a pin 43. Each roller is provided with a ratchet-pawl mechanism . Each mechanism includes a ratchet wheel 44, 45 turnably mounted on the respective arm and fixedly connected with the respective roller for joint rotation therewith, and a pawl 46,47 fixedly connected with the respective arm. When the arms 41 and 42 are moved toward one another, the pawls 46,47 act on and turn the ratchets 44,45 and thereby turn the rollers 3''' and 4''' so that the latter move and squeeze the toothpaste container.

The invention is not limited to the details shown since various modifications and structural changes are possible without departing in any way from the spirit of the present invention.

What is desired to be protected by Letters patent is set forth in the appended claims.

I claim:

1. A device for supporting a toothpaste container, comprising means for engaging a toothpaste container and moving the container with simultaneous squeezing of the container to push its contents outwardly of the container; means for activating said engaging and moving means and operable by the user so as to activate said engaging and moving means and thereby to squeeze the container, said engaging and moving means including two rotatable rollers forming a gap therebetween for engaging the container and pulling the container through the gap during their rotation for squeezing a container, said activating means including gearings provided on said rollers and gear racks engaging with said gearings and operable by a user; a housing having a stationary housing portion which supports said rollers, and a movable housing portion which supports said gear racks and can be moved by a user to operate said gear racks, said rollers being spaced from one another in the vertical direction, said housing portions being also spaced from one another in the vertical direction and said movable housing portions being movable by a user relative to said stationary housing portion in a vertical direction, one of said gear racks being mounted on said movable housing portion and engaging an upper one of said rollers, while the other of said gear racks is mounted on said stationary housing part and engages a lower one of said rollers.

2. A device for supporting a toothpaste container, comprising means for engaging a toothpaste container and moving the container with simultaneous squeezing of the container to push its contents outwardly of the container; means for activating said engaging and moving means and operable by a user so as to activate said engaging and moving means and thereby to squeeze the container, said engaging and moving means including two rotatable rollers forming a gap therebetween for engaging the container and pulling the container through the gap during their rotation for squeezing the container, said activating means including a ratchet-pawl mechanism associated with each of said rollers, said activating means including two arms pivotally connected with one another and turnable by a user, each of said mechanisms having a pawl mounted on a respective one of said arms and a ratchet mounted on a respective one of said rollers and turnable by said pawl to turn said roller in response to turning of said arms by a user.

* * * * *